US009605391B1

(12) United States Patent
Ayala

(10) Patent No.: US 9,605,391 B1
(45) Date of Patent: Mar. 28, 2017

(54) RAPID REPAIR SYSTEM FOR BUCKLED SIDEWALKS

(71) Applicant: John M Ayala, Albuquerque, NM (US)

(72) Inventor: John M Ayala, Albuquerque, NM (US)

(73) Assignee: BUCKLEDOWN SYSTEMS, LLC, Albuquerque, NM (US)

( * ) Notice: Subject to any disclaimer, the term of this patent is extended or adjusted under 35 U.S.C. 154(b) by 0 days.

(21) Appl. No.: 14/939,070

(22) Filed: Nov. 12, 2015

(51) Int. Cl.
*E01C 11/00* (2006.01)
*E01C 23/10* (2006.01)

(52) U.S. Cl.
CPC ..... *E01C 11/005* (2013.01); *E01C 23/10* (2013.01)

(58) Field of Classification Search
CPC ..... E01C 11/005; E01C 23/10
USPC ..... 404/74, 78
See application file for complete search history.

(56) References Cited

U.S. PATENT DOCUMENTS 2,007,457 A * 7/1935 Peters ..... E01C 23/10 404/108
2,074,756 A * 3/1937 Poulter ..... E01C 23/10 404/108
4,036,472 A 7/1977 Orndorff
4,372,533 A 2/1983 Kaus
4,470,719 A * 9/1984 Dziark ..... E01C 23/10 404/47
5,506,012 A 4/1996 Wright
6,068,425 A * 5/2000 Fershtut ..... E01C 23/10 404/78
6,419,127 B1 * 7/2002 Fershtut ..... E01C 23/10 222/319
6,521,673 B1 * 2/2003 Brown ..... C08G 18/4804 404/78
6,558,071 B1 * 5/2003 Sproules ..... E01C 5/08 404/78
6,976,804 B1 * 12/2005 Asplin ..... E01C 23/10 404/78
8,092,116 B1 * 1/2012 Asplin ..... E01C 23/10 404/78
8,459,897 B1 * 6/2013 Knapp ..... E01C 23/06 254/264
2014/0255105 A1 * 9/2014 Asplin ..... B66F 3/247 405/230

* cited by examiner

*Primary Examiner* — Raymond W Addie

(57) ABSTRACT

A buckled sidewalk repair system capable of equally lifting both sides of the defect in order to cut one or both slabs to an appropriate size then return them to a level position. A method of repairing a buckled sidewalk includes using a pneumatic bladder crafted of an airtight fabric composite able to contain sufficient pressure to lift the specified load. With this device and method a crew of two can repair the buckled sidewalk in two hours with a minimum of equipment, saving time, resources, machinery, personnel, and money.

20 Claims, 2 Drawing Sheets

RAPID REPAIR SYSTEM FOR BUCKLED SIDEWALKS

BACKGROUND OF THE INVENTION

Field of the Invention

The present invention relates to an apparatus and a rapid method of repairing in place, sidewalks buckled due to thermal expansion or ground movement. It is a pneumatic device and evenly supports both existing slabs of the section as they are resized and lowered back into place.

Description of Prior Art

Concrete sidewalk buckling is found in all latitudes and is commonly caused by thermal expansion, ground movement or tree roots. The conventional method of repair involves the demolition and disposal of the offending segments, then placing and finishing new concrete in the void. This involves significant resources in manpower, vehicles, equipment, and fresh concrete, as well as barricading the sidewalk pathway along with the adjoining traffic lane for several days. Typically a crew of three to nine workers along with their vehicles and sundry equipment demolish the segments and haul the resulting debris to the landfill. A concrete mixing truck then drives in to dispense fresh concrete which is finished and left to cure for another day. The process is time and labor intensive in addition to disrupting the location for days and producing debris plus other pollutants (dust, vehicle emissions, and extended noise). Users of the path are inconvenienced while the path is blocked.

PRIOR ART

U.S. Pat. No. 5,506,012 Apr. 9, 1996 Multiple Chamber Lift Bag "A lift bag includes a plurality of independently inflatable chambers for controlling lifting of objects. Each chamber is defined by an upper surface sheet and a lower surface sheet, the upper surface sheet of one chamber positioned below an adjacent chamber being securely attached to the lower surface sheet of an adjacent chamber. The lift bag can be operated at pressures of about 15 psig at specified heights which allows greater flexibility compared to conventional, single-chambered lift bag which operate at pressures of about 7 psig. Preferably, all seams, reinforcements, and fittings are vulcanized in place using uncured rubber coated fabric. Grommets or other securing means may provide further stability to the lift bag."

The former devices employing multiple chambers are unnecessarily complicated for this application as the device requires a multitude of separate parts and seams which are inadequate for the present application. Further, it is designed to be reusable, adding expense and complexity through the addition of removable parts where the current invention is designed to be consumed in the application employing fewer permanently bonded parts. Where the former invention necessitates a plurality of devices for stability, the current invention is stabilized by its three point contact with the loads and the ground.

SUMMARY OF THE INVENTION

The present invention is a pneumatic bladder of fixed volume which, when inflated, supports both segments of the defect so they may be resized. It then lowers the repaired segments back into their original position, restoring a level and safe walkway. The remaining open joints are filled with an appropriate elastomeric compound.

It is the primary objective of the present invention to provide a safe and rapid sidewalk repair system which will significantly increase the economy of buckled sidewalk repairs.

It is another object of the present invention to provide a rapid sidewalk repair system which will significantly increase the convenience of making sidewalk repairs at a significant savings.

It is a further object of the present invention to provide a rapid sidewalk repair system which can easily be operated by a crew of two workers, minimizing labor costs and resources required.

It is still another object of the present invention to provide a rapid sidewalk repair system which can repair buckled sidewalks much faster, much cheaper, more safely, with higher quality, and with greatly reduced disruption of the pathway and adjoining traffic lane and businesses or homes.

These and other objects of the present invention will become apparent to those skilled in this art upon reading the accompanying description, drawings and claims set forth herein. The headings herein are provided for the convenience of the reader only. No headings should be construed to be limiting on the content in any way.

DETAILED DESCRIPTION OF THE INVENTION

Bladder as used herein shall mean the fixed volume Pneumatic Sidewalk Buckle Repair Apparatus made of a PVC composite fabric or similar material which, in use, is filled with a compressed gas.

Cut Shield shall mean the device or material attached to the bladder or placed between the bladder and slab under the cut line to protect the bladder from the concrete saw blade should it penetrate lower than the bottom of the slab.

Slab shall mean the section of concrete sidewalk as defined by original forms and joints.

The bladder, when filled with a compressed gas, lifts both existing slabs equally, allowing one or both slabs to be cut.

It requires two measurements and a simple calculation to determine where to cut the slab.

The bladder lowers the slabs into a level configuration when deflated.

It may be re-inflated to help re-position slabs if necessary.

The bladder remains under the slabs when the repair is complete.

It reduces dramatically the amount of equipment required to repair a buckled sidewalk.

It requires extended length tools to clear debris and level soil under the slabs.

It facilitates placement of grout or other material under the slabs to increase stability.

It eliminates 95% of the waste produced in a standard repair that would otherwise be hauled to a landfill.

It reduces dramatically the time the site is blocked and disrupted for repair.

It reduces the required repair crew to two workers.

It permits the repair to be performed with all equipment, supplies and crew transported in one pickup truck.

It increases the number of repairs that can be accomplished in a day.

It increases the number of repairs that can be accomplished on a fixed budget.

It frees extra workers to other projects.

It increases the number of repairs that can be performed by a small company with existing crew.

It permits a cleaner jobsite and simplified cleanup afterward.

It may be used to repair certain other defects.

It may be used for lifting certain other materials or structures.

It may be filled with grout or other polymer substance to increase the stability of the repaired area.

BEST MODE OF THE INVENTION

Figure 1:
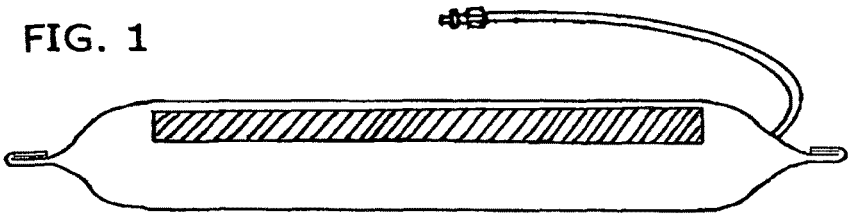
FIG. 1 is a side view of the sidewalk repair device according to the present invention.
Figure 2:
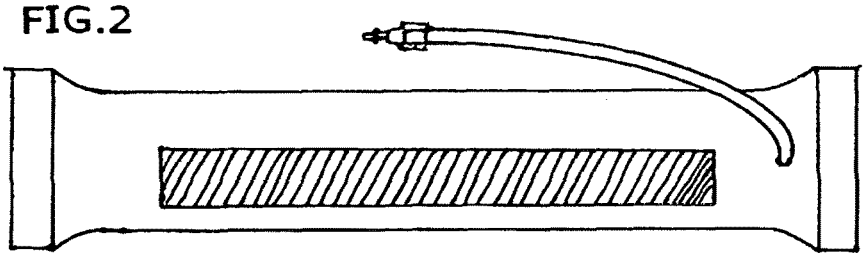
FIG. 2 is a top view of the sidewalk repair device according to the present invention.
Figure 3:
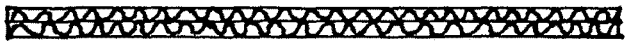
FIG. 3 is an edge view of one proposed cut shield configuration.
Figure 4:
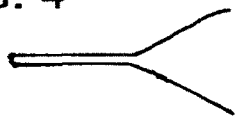
FIG. 4 is a side view of the cylinder end pressed shut.
Figure 5:
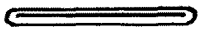
FIG. 5 is an end view of the end seal of FIG. 4.
Figure 6:
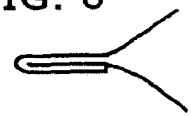
FIG. 6 is a side view of the end seal folded over and bonded to itself.
Figure 7:
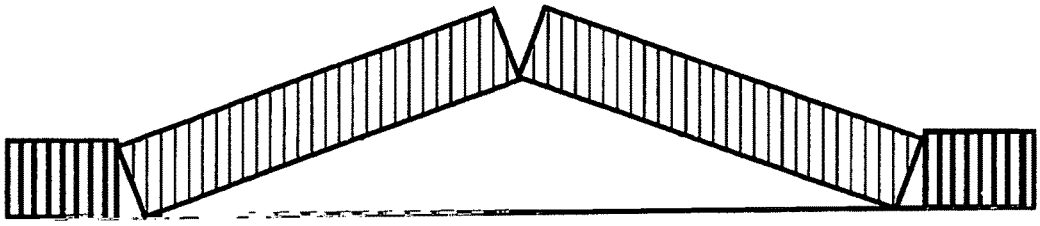
FIG. 7 is an end view of a buckled sidewalk
Figure 8:
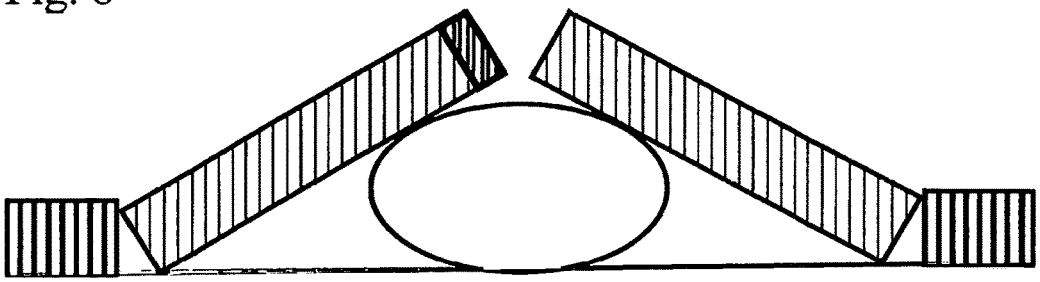
FIG. 8 is an end view of the buckled sidewalk with the bladder and cut shield in place, lifting the slabs and indicating material to be removed.
Figure 9:
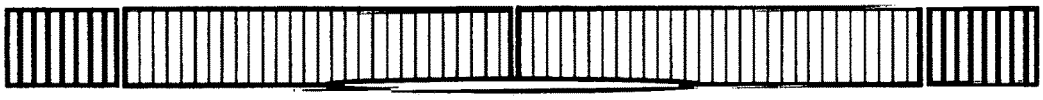
FIG. 9 is an end view of the bladder deflated and sidewalk slabs in a level position.

FIGS. 1-6 show the best mode contemplated by the inventor, according to the concepts of the current invention.

How to Make the Invention:

A cylinder is created of a single sheet of an air tight fabric composite, such as PVC coated polyester, joined along the length using a hot air welding process. The ends are sealed with the same method after an air hose fitting is attached through the fabric near one end. There a filler hose is connected and a standard air hose coupler or valve terminates the hose. The cut shield material may be attached to or separate from the bladder for ease of positioning. The cut shield is located on top of the bladder under the cut line marked on the top of the slab.

How to Use the Invention:

The bladder is placed under the buckle with the cut shield beneath the cut line and is carefully watched as the bladder is inflated with a gas, lifting both slabs and relieving compression on the joint. With the slabs supported from beneath and cut shield properly aligned along the cut line, proceed to cut the slab using a portable concrete saw held perpendicular to the surface of the slab. After the final cut is made, paying attention to the depth of the cut to just touch the shield, lift out the cut off portion and dispose of. Watching the alignment of the open joints, release gas from the bladder till the slabs are level. If there should be any anomaly, the bladder can be re-inflated and adjustments made. Once the slabs are level, remove fittings and any excess hose, fill joints with backer rod and elastomeric sealer.

The device reduces the manpower and equipment to make this repair by more than half. The number of vehicles required is reduced to one, including no longer needing to transport fresh concrete to the site or haul away the debris to a landfill. Disruption and blocking of the sidewalk and adjoining traffic lane is reduced from days to approximately two hours. Debris under buckled sections is cleared with appropriate tools to restore a flat soil surface. These tools consist of an eight foot metal handle with a small flat surface perpendicular to the handle, used to remove debris from the tight spaces beneath the slabs and level the soil. The second tool resembles a t-shaped hoe to pull the debris up and over the curb as needed without ever placing one's hands under the concrete slabs. Next the measurement is taken from the edge of the last flat slab along the side of the defect to the edge of the next flat slab. Then a measurement is taken of the top surfaces of the buckled slabs from which the first measurement is subtracted less an extra ¾ to 1 inch. The solution is the amount to be removed from one of the slabs at the peak of the buckle. Mark a line across the slab at this dimension for the cut.

The invention claimed is:

1. A method of repairing a buckled sidewalk comprising the steps of: inserting a pneumatic bladder of fixed volume under the buckled area of the sidewalk, Positioning the bladder so that a cut shield is facing upward under the buckled area and a filler tube extends between the bladder and a source of compressed air, inflating the bladder with a gas, measuring and cutting the buckled pieces of the sidewalk so that there remains a gap between the cut ends, deflating the pneumatic bladder which will remain under the cut sidewalk filling any voids beneath the raised sidewalk with a structural filler material, providing an expansion gap for future linear expansion, removing said filler tube and, filling all joints with elastomeric sealer.

2. The method of repairing a buckled sidewalk according to the claim 1 wherein a pneumatic bladder of fixed volume is employed.

3. The method of repairing a buckled sidewalk according to the claim 1 wherein the pneumatic bladder lifts both slabs of the buckle equally to relieve compression on the buckled joint.

4. The method of repairing a buckled sidewalk according to the claim 1 wherein the pneumatic bladder lifts the slabs so as to permit the cutting of one or both slabs.

5. The method of repairing a buckled sidewalk according to the claim 1 wherein providing a spacer strip to protect the pneumatic bladder from the cutting blade.

6. The method of repairing a buckled sidewalk according to the claim 1 wherein the pneumatic bladder employs pneumatic pressure from a compressed gas to lift the slabs.

7. The method of repairing a buckled sidewalk according to the claim 1 wherein the pneumatic bladder lowers the slabs into place to complete the repair as the gas is released.

8. The method of repairing a buckled sidewalk according to the claim 1 wherein the pneumatic bladder can be re-inflated to adjust and position the slabs if needed, until the filler tube is removed.

9. The method of repairing a buckled sidewalk according to the claim 1 wherein the pneumatic bladder can be utilized to raise roadway and other concrete slabs.

10. The method of repairing a buckled sidewalk according to the claim 1 wherein the pneumatic bladder raises the slabs from below without drilling, prying, or otherwise requiring damaging the slabs.

11. The method of repairing a buckled sidewalk according to the claim 1 wherein the pneumatic bladder is sacrificial, as it remains under the sidewalk when repair is complete.

12. The method of repairing a buckled sidewalk according to the claim 1 wherein the pneumatic bladder facilitates the placement of new expansion joint material in the new joints produced.

13. The method of repairing a buckled sidewalk according to the claim 1 wherein the system utilizes the existing concrete slabs.

14. The method of repairing a buckled sidewalk according to the claim 1 wherein the method requires extended length tools to remove debris and level the soil beneath the buckled sections.

15. The method of repairing a buckled sidewalk according to the claim 1 wherein the system requires a saw to cut the concrete.

16. The method of repairing a buckled sidewalk according to the claim 1 wherein the method requires a measurement and calculation to determine the proper location of the cut.

17. The method of repairing a buckled sidewalk according to the claim 1 wherein the method requires the measurement from edge of level slab to edge of next level slab and subtracted from the measurement over the peak of the defect to determine the size of the segment to be cut and removed.

18. The method of repairing a buckled sidewalk according to the claim 1 wherein any voids beneath the leveled sidewalk may be filled with a grout for increased stability.

19. The method of repairing a buckled sidewalk according to the claim 1 wherein the bladder may be filled with a grout or polymer to provide additional stability and fill voids.

20. The method of repairing a buckled sidewalk according to the claim 1 wherein the bladder material may be of a variety of PVC and fabric composites.

* * * * *